United States Patent [19]

Takeda et al.

[11] 4,074,556

[45] Feb. 21, 1978

[54] APPARATUS FOR ROLL WORKING

[75] Inventors: Kouichi Takeda, Okazaki; Hiroshi Sato; Toshimi Onishi, both of Toyota, all of Japan

[73] Assignee: Toyota Jidosha Kogyo Kabushiki Kaisha, Japan

[21] Appl. No.: 755,082

[22] Filed: Dec. 28, 1976

[30] Foreign Application Priority Data

Aug. 8, 1976 Japan ..... 51-094351

[51] Int. Cl.[2] ..... B21H 9/00

[52] U.S. Cl. ..... 72/196; 72/191; 72/252

[58] Field of Search ..... 101/53, 54, 18, 22; 113/113 R; 72/191, 196, 252; 425/363

[56] References Cited

U.S. PATENT DOCUMENTS 52,630 2/1866 Waters ..... 72/252

614,111 11/1898 Johnston ..... 72/252

727,532 5/1903 Bennett ..... 72/252

*Primary Examiner*—Lowell A. Larson

*Attorney, Agent, or Firm*—Browdy and Neimark

[57] ABSTRACT

A roll working apparatus for use in forming, pressing, punching, shearing, etc., comprising a pair of rolls on each surface of which a plurality of male or female impression portions having dissimilar form or configuration, a work-feeding means for selectively supplying a work to the working position of any one specific pair of the impression portions once per each rotation of the rolls, and a phase (or timing) adjusting means for the selective feeding of the work, in order to enjoy the merit of carrying out a desired process of production, without doing troublesome and time-consuming change of the rolls, only by adjusting the phase adjusting means and, if necessary, work-feeding means.

10 Claims, 8 Drawing Figures

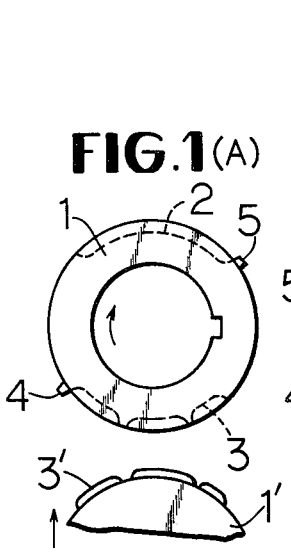
FIG.1(A)
FIG.1(B)
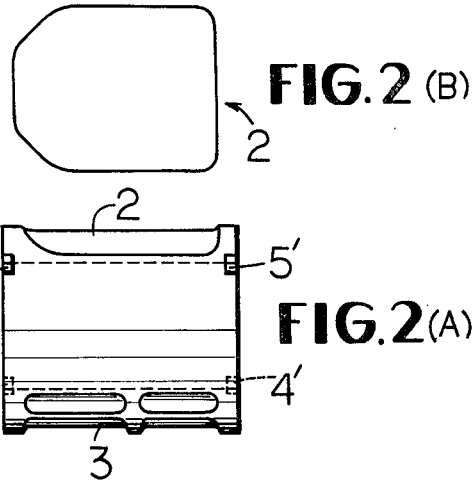
FIG.2(B)
FIG.2(A)
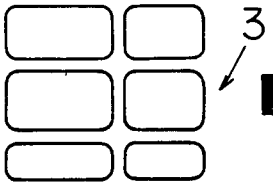
FIG.2(C)
FIG.4
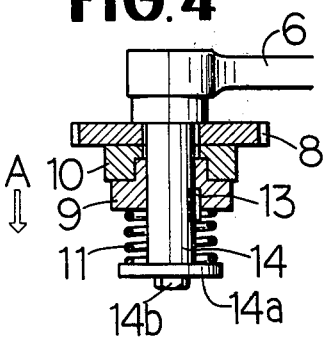
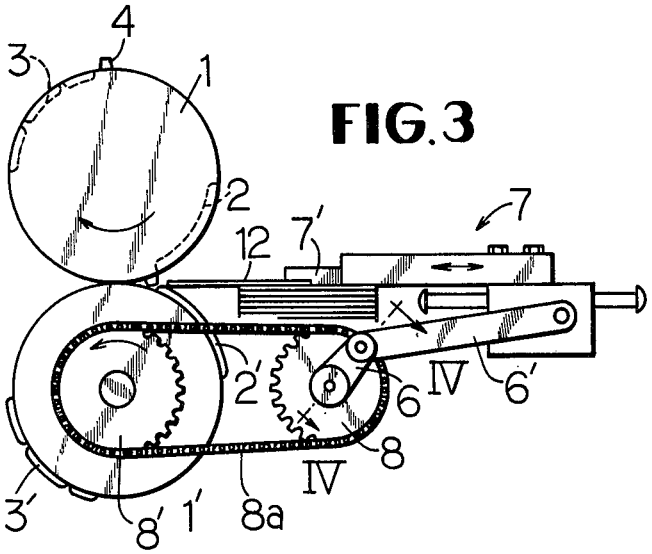
FIG.3
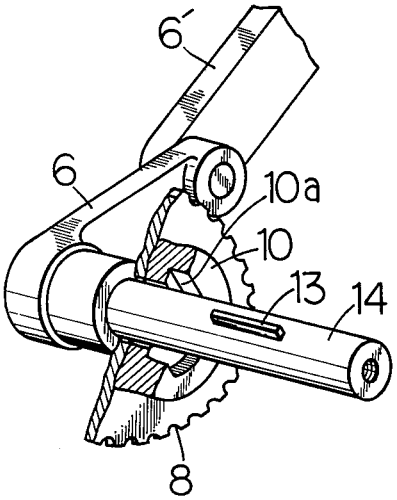
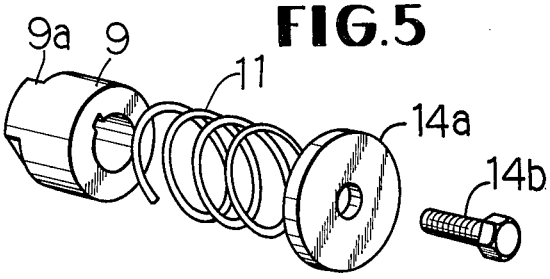
FIG.5

APPARATUS FOR ROLL WORKING

BACKGROUND OF THE INVENTION

In the conventional roll working apparatuses, a changing of impression, or changing of the rolls is inevitable each time when carrying out press working of various kinds with the employment of different impression. This changing of impression is a time-consuming and troublesome operation, and is in addition a highly complicated work requiring a precise adjustment and confirmation such as (1) adjustment of interaxial distance, (2) correction of discrepancy between the male and female impression portions in the axial directions, and (3) confirmation of right phase in the rotating direction of the rolls. In the roll working accompanied by a process such as shearing, punching or cutting, the permissible tolerance of adjustment is so small that it is liable to increase the time for arrangement and thus, to prevent the reduction of labor time. Various attempts have been made for minimizing the time needed in changing the impression or the rolls; some are good reducing the time, bringing about however an undesirable result of greatly increasing the extra expenditure. At present, no proper method, simple and economical, of reducing the changing time of the impression is known.

SUMMARY OF THE INVENTION

The present invention is aimed at the elimination of the abovementioned shortcomings or defects in the conventional apparatuses. It is, therefore, a primary object of this invention to provide an apparatus for roll working which enables processing articles of dissimilar configuration, without conventionally essential taking-out and refitting of impression, or changing the rolls, and thereby makes it possible to convert the usage of the apparatus from the conventional mass production system for articles of a specific configuration to a repeated production system for different configuration articles, irrespective of the production quantity, small or large.

It is another object of this invention to provide an improved apparatus for roll working having a pair of rolls, on each of which a plurality of dissimilarly formed male of female impression portions are carved, as pairs of male and female, for enabling the process of any one of the differently shaped articles on the same pair of rolls only by properly adjusting the work-feeding timing in order to adapt it to the rotation phase of the rolls.

It is still another object of this invention to provide an improved apparatus for roll working wherein the plurality pairs of impression may be two, three, or more in number thereof and the arranged position of these impression may not always be regularly spaced from one another, in accordance with the proper corresponding modifications in the construction of the work-feeding means and timing adjustment means for that, etc.

BRIEF DESCRIPTION OF THE DRAWING

FIG. 1 (A) is a side elevational view in section of an essential part of an embodiment of this invention showing female impression portions or dies on one roll;

FIG. 1 (B) is a similar elevational view of the other roll, partly cut away, with male impression dies for engaging with the female ones;

FIG. 2 (A) is a front elevational view of FIG. 1 (A);

FIG. 2 (B) is a developed plan view of the female impression portions;

FIG. 2 (C) is a developed plan view of the female impression portions;

FIG. 3 is a schematic general side view of the embodiment;

FIG. 4 is a vertical cross-sectional view of an essential part of the embodiment taken along the line IV — IV of FIG. 3; and FIG. 5 is an exploded perspective view of the joint fitting part shown in FIG. 4.

DETAILED DESCRIPTION OF THE PREFERRED EMBODIMENT

Referring to the drawings a preferred embodiment of the present invention will be described hereinunder. Structure: As can be seen in FIGS. 1 to 5 there are plurality of female impression portions or concavedly shaped dies 2 and 3, different in shape from each other, carved or inlaid on the surface of a first roll 1; on a second roll 1' confronting thereto are carved or inlaid a plurality of male impression portions or convexedly shaped dies 2' and 3', different in shape from each other, in such a way as to correspondingly engage with the female dies respectively. And dies 2 and 3 are disposed at the diametrically opposite position; one is lagged from the other 180° in the rotation angle, that is in phase, of the roll shaft. Work-positioning means or work-stoppers 4 and 5 are projections fixedly fitted on the first roll for the purpose of positioning a work 12, for example a piece of steel plate, when it is feeded or inserted for being worked. A work-feeding means 7 is provided with an arm 7', being freely reciprocable, for pushing the work 12 in timed relationship with the rotation or phase of the rolls 1 and 1'. A pair of sprockets 8 and 8' driven by an endless chain **8*a* for power transmission are coupled to the work-feeding means 7 through link members 6 and 6' as can be seen in FIGS. 3 and 4. As being illustrated in FIGS. 4 and 5 a male and a female joint members 9 and 10 can be easily engaged or disengaged for changing mutual positional relation, that is for switching the phase relation between both; the joint members 9, 10 are allowed to relatively slide in the axial direction for that purpose, because of their engageable two parallel sides 9*a*, 10*a*. The joint member 9 is slidably but nonrotatably connected to the link member 6 by means of a key 13 secured to a shaft 14; the joint member 10 is integrally formed with the sprocket 8 and both members 8, 10 are loosely fitted to the shaft 14. A coil spring 11, being in abutment at one end thereof with a washer fixed onto one tip of the shaft 14 and at the other end thereof with the joint member 9, constantly urges the joint member 9 against the joint member 10. Function: When processing articles by means of the dies 2, 2', as illustrated in FIG. 3, the length of the arm 7' of the work-feeding means 7 is first adjusted in such a way as to make the work 12 being fed between the rolls immediately after having hit the stopper 5 to locate the work 12 at the right position or phase to the die 2 of the roll 1; as the rotation of the rolls are synchronized with the work-feeding means 7 by virtue of the gearing between the chained sprockets 8, 8' and the link member 6, 6', so the supplying of the work 12 is naturally synchronized with the engaging of the impression portions or dies 2, 2' carved in pairs of the rolls 1, 1'**. As with the case in the conventional roll working apparatus, each rotation of the rolls will also produce in this embodiment a piece of article; it means that as many pieces of articles can be produced, by repeating this operation, as the number of rotation of the rolls.

A distinctive peculiarity of this embodiment, which can not be observed in the conventional apparatuses, resides in that the pair of rolls 1, 1' are provided with another pair of impression portions or dies 3, 3', in addition, different in form or configuration from the above described dies 2, 2'. The other pair of dies 3, 3', disposed for proper engagement, will similarly produce another kind of articles so long as they are supplied with the works in a well timed relation by the work-feeding means 7, with an arm 7' of a length suitable for the works.

A case of producing another article by means of another impression will be described more in detail. The dies 3, 3' are carved or disposed in the lag of 180° rotation angle to the dies 2, 2' respectively, so the feeding of the work 12 to be processed shall be lagged as much as 180° in the timing thereof; that is in the phase with the pair of rolls, such that the work 12 may be inserted in response to the hitting against the stopper 4. The way of switching this timing or phase is a quite simple operation; the joint member 9 is pulled back in the direction A hinted by the arrow mark in FIG. 4 for disengagement from the joint member 10 resisting the compressive force of the spring 11 and it is re-engaged with the joint member 10 after having been inverted upside down by means of rotation of the link member 6 by 180°. The completion of the timing adjustment makes a repetitive processing of works with the dies 3, 3' possible to produce as many articles as the number of rotation of the rolls. Modifications: The above description is not for limited the scope of this invention, but for simpliying the illustration with the object of better understanting. Many modifications can be thought, which will be apparatus for those versed in the art through further studying of the undermentioned description and the appended claims referring to the accompanying drawings.

For example, three pairs of impression or more may be carved on the surface of the rolls instead of two pairs already explained. In case of employing three pair of dies, the joint members 9 and 10 for the timing adjustment shall be essentially provided with a joint portion of triangular or its multiple prism form.

Apart from the number of pairs of the impression, a position arrangement thereof may be allowed some modifications. Arrangement of dies on the rolls with equal space between them is not always required; dies of larger or smaller sizes may be suitably arranged according to the desire of processing on the surface of the rolls. In this case, the timing adjustment problem on the work-feeding means 7 can be solved in some ways, such as by properly selecting a suitable phase angle of the link member 6 to the sprocket 8 through employing a spline joint, for example, between the joint members 9 and 10, preferably indexed to be able to select a desired phase angle therebetween, and/or by lengthening or shortening the dimension of the arm 7' of the work-feeding means 7. Effects: This invention, as can be easily understood from the above, makes it possible to process articles of various forms or configuration conveniently without changing the impression each time, so long as the initial adjustment of the impression on the rolls are accurately done. Changing of the impression on the same pair of rolls, from one impression to another, may be performed only by adjusting the timing of the work-feeding means quite easily in a short period of time, that is a so-called single stroke operation.

The roll working method has its greatest merit in the field of mass production with its high productivity. This advantage is often diminished in its characteristics by the time-consuming changing operation of the impression or by the adjustment operation of low efficiency. It is an epochmaking improvement therefore in the roll working that is invention has succeeded in the elimination of the changing impression or dies when making a transference from the production of one article to another, and in the simplification of timing adjustment of the work-feeding means. The effect of this invention is more conspicuous in the case wherein the transference of production between articles of various forms or shapes are frequently needed according to the requirement of inventory control, production control or some other reasons.

The effects of this invention can be summarized as follows: (1) shortening of the time for re-arrangement by a great margin in comparison with the conventional method; (2) saving of labor needed hitherto for changing impression; (3) elimination of the complicated adjustment or confirmation operation; and (4) establishment of a production system suitable not only large quantities production of various kinds but also for repeated small quantities production of various kinds, while preserving the greatest merit of the roll working, a high efficient productivity.

It will be obvious to those skilled in the art that various changes may be made without departing from the scope of the invention and the invention is not to be considered limited to what is shown in the drawings and descrined in the specification.

We claim:

1. A roll working apparatus for processing a work between paired impressions on a pair of rolls, comprising:

a pair of synchronously rotating rolls, wherein one of said rolls is provided with a plurality of male impressions, each of which is arranged on the roller surface thereof, and the other of said rolls is provided with a corresponding number of female impressions, each of which is engageable with one of said male impressions, one after another, during each complete rotation of said pair of rolls;

a plurality of work-positioning means disposed on one of said rolls for regulating the position of the work fed to the rolls;

feeding means for selectively feeding the work to one of said positioning means such that the work can be selectively fed to any desired pair of impressions; and timing means for controlling the timing of said selective feeding of the work to any desired pair of impressions.

2. A roll working apparatus as set forth in claim 1, wherein said feeding means comprises a freely reciprocable feeding arm of a specific length suitable to feed the work to a selected specific impression.

3. A roll working apparatus as set forth in claim 2, wherein said plurality of work-positioning means are stoppers projected from one of said pair of rolls.

4. A roll working apparatus as set forth in claim 3, wherein said timing means comprises:

communicating means, linking said rolls to said feeding means, for communicating the motion of one of said rolls to said feeding means to that every rotary movement in said roll causes a corresponding movement of said feeding means; and phase change means attached to said communicating means for changing the phase relationship between the rotary movement of said rolls and the corresponding movement of said feeding means.

5. A roll working apparatus as set forth in claim 1, wherein said timing means comprises:

communicating means, linking said rolls to said feeding means, for communicating the motion of one of said rolls to said feeding means so that every rotary movement in said roll causes a corresponding movement of said feeding means; and phase change means attached to said communicating means for changing the phase relationship between the rotary movement of said rolls and the corresponding movement of said feeding means.

6. A roll working apparatus as set forth in claim 5, wherein said pairs of male and female impressions on said rolls are dissimilar in shape for each pair, are two in number and are positioned 180° from each other on the surface of said rolls; said stoppers are two in number; and said phase change means permits a change of phase of 180° between the rotating movement of said rolls and the corresponding movement of said feeding means, thus permitting the work to be selectively fed to said rolls at either of said two pairs of impressions.

7. A roll working apparatus as set forth in claim 5, wherein said pairs of male and female impressions on said rolls are dissimilar in shape for each pair, are three or more in number and are positioned at equally spaced intervals on the surface of said rolls; said stoppers are three or more in number; and said phase change means permits a change of phase corresponding to the number of said pairs of impressions, thus permitting the work to be selectively fed to said rolls at any of said pairs of impressions.

8. A roll working apparatus as set forth in claim 5, wherein said pairs of male and female impressions on said rolls are disposed with unequal space therebetween; said stoppers are as many as the number of said pairs of impressions; and said phase change means is so constructed as to be adapted to the irregular disposition of the impressions, thus permitting the work to be selectively fed to said rolls at any of said pairs of impressions.

9. A roll working apparatus as set forth in claim 1, wherein each of said male impressions is dissimilar to the other male impressions and, accordingly, each of said female impressions is dissimilar to the other female impressions.

10. A roll working apparatus as set forth in claim 1, wherein said timing means comprises:

two sprocket wheels, the first of which is attached to one of said rolls so that when said roll rotates, said sprocket wheel rotates with equal angular velocity;

an endless chain connecting said sprocket wheels;

a link means, connected to said second sprocket wheel and to said work feeding means, for causing one complete reciprocation of said feeding means with each complete rotation of said second sprocket wheel; and phase change means, connected to said control sprocket wheel and said linking means for permitting disengagement of said link means to selectively permit a predetermined rotational movement of said rolls without causing a corresponding change in the position of said feeding means.

* * * * *